US005231842A

United States Patent [19]

Manz et al.

[11] Patent Number: 5,231,842

[45] Date of Patent: Aug. 3, 1993

[54] REFRIGERANT HANDLING SYSTEM WITH LIQUID REFRIGERANT AND MULTIPLE REFRIGERANT CAPABILITIES

[75] Inventors: Kenneth W. Manz, Paulding; Gregg Laukhuf, Bryan, both of Ohio

[73] Assignee: SPX Corporation, Muskegon, Mich.

[21] Appl. No.: 900,522

[22] Filed: Jun. 17, 1992

Related U.S. Application Data

[63] Continuation of Ser. No. 641,433, Jan. 15, 1991.

[51] Int. Cl.[5] ..... F25B 45/00

[52] U.S. Cl. ..... 62/77; 62/149

[58] Field of Search ..... 62/212, 225, 149, 292, 62/77; 236/99 E

[56] References Cited

U.S. PATENT DOCUMENTS

| | | | |
|---|---|---|---|
| 2,008,663 | 7/1935 | Dillman | 62/225 X |
| 2,410,795 | 11/1946 | Dillman | 236/99 E |
| 2,583,178 | 1/1952 | Huntington | 62/223 |
| 4,745,767 | 5/1988 | Ohya et al. | 62/225 X |
| 4,879,879 | 11/1989 | Marsala et al. | 62/225 X |
| 5,040,382 | 8/1991 | Abraham | 62/149 X |

*Primary Examiner*—William E. Wayner

*Attorney, Agent, or Firm*—Barnes, Kisselle, Raisch, Choate, Whittemore & Hulbert

[57] ABSTRACT

A refrigerant handling system that includes a compressor for pumping refrigerant through the system, and an evaporator connected to the compressor inlet for ensuring that refrigerant fed to the compressor inlet is in vapor phase. A flow control device is coupled to the inlet of the evaporator for controlling flow of refrigerant to the evaporator, and comprises a thermostatic expansion valve having first and second pressure inputs, and valve elements for controlling flow of refrigerant through the valve to the evaporator as a function of a pressure differential between the pressure inputs. A first bulb containing refrigerant is sealingly coupled to the first pressure input of the valve, and is positioned so as to supply a first control pressure to the valve as a function of vapor pressure of refrigerant in the bulb at the temperature of refrigerant entering the evaporator. A second bulb containing the same type of refrigerant is sealingly coupled to the second pressure input of the valve, and is positioned to supply a control pressure to the second valve input as a function of vapor pressure of refrigerant at the temperature of refrigerant exiting the evaporator.

5 Claims, 2 Drawing Sheets

REFRIGERANT HANDLING SYSTEM WITH LIQUID REFRIGERANT AND MULTIPLE REFRIGERANT CAPABILITIES

This is a continuation of copending application Ser. No. 07/641,433 filed on Jan. 15, 1991.

The present invention is directed to refrigerant handling systems of the type that employ a compressor for pumping refrigerant through the system, and more particularly to a device for controlling flow of refrigerant to the compressor inlet in such a way as to insure that refrigerant at the compressor inlet is in vapor phase independent of the type of refrigerant flowing through the system.

BACKGROUND AND OBJECTS OF THE INVENTION

U.S. Pat. No. 4,768,347, assigned to the assignee hereof, discloses a refrigerant recovery system that includes a compressor having an inlet coupled through an evaporator and through a solenoid valve to the refrigeration equipment from which refrigerant is to be withdrawn, and an outlet coupled through a condenser to a refrigerant storage container or tank. The refrigerant storage container is carried by a scale having a limit switch coupled to control electronics to prevent or terminate further refrigerant recovery when the container is full. The scale comprises a platform pivotally mounted by a hinge pin to a wheeled cart, which also carries the evaporator/condenser unit, compressor, control electronics, and associated valves and hoses.

There is a need for refrigerant handling equipment, including refrigerant recovery equipment of the type disclosed in the above-noted U.S. Patent, that can handle differing types of refrigerants, such as R12, R22 and R502. U.S. Pat. No. 4,939,905, also assigned to the assignee hereof, discloses such a system, including a multiple-section condenser and means responsive to refrigerant temperature and pressure at the outlet of the evaporator for automatically and selectively controlling flow of refrigerant from the compressor outlet to the individual condenser sections. However, a problem remains relative to controlling inlet flow to the evaporator and compressor for various types of refrigerant so as to maximize overall recovery speed for either liquid-phase or vapor-phase inlet refrigerant, while ensuring that refrigerant at the compressor inlet is in vapor-phase so as to prevent slugging at the compressor. Further, it is desirable to control the inlet refrigerant flow in such a way as to minimize superheating of the refrigerant in the evaporator, which reduces efficiency of the handling system and the amount of refrigerant that can be pumped therethrough.

It is conventional practice to control liquid refrigerant flow with a flow control device such as a capillary tube, an orifice tube or an expansion valve. Normally, an expansion valve can be used to control flow of a single refrigerant type, necessitating multiple valves for a system intended to be capable of handling multiple refrigerant types. A capillary tube can be employed as a compromise to control flow of multiple refrigerants having liquid feed to the inlet. A problem with each of these options, however, is that the flow control device suited for liquid flow control greatly reduces the flow rate of refrigerant vapor, which would occur the majority of the time in the case of a refrigerant recovery system, for example. A sight glass and a manual valve could be employed so that the operator could observe through the sight glass whether liquid or vapor refrigerant is flowing through the system, and manually switch refrigerant flow through a flow control device where liquid refrigerant is observed, or through a bypass line when vapor phase is observed. This option requires manual observation and control. In addition, the flow control device, such as a capillary tube, would be optimized for one type of refrigerant, but would be less than optimum for other refrigerant types where the system is intended to operate with multiple refrigerant types.

It is therefore a general object of the present invention to provide a refrigerant handling system, such as a refrigerant recovery system, that includes the capability of handling inlet refrigerant in either vapor phase, liquid phase or mixed liquid/vapor phase, that is adapted to optimize flow of refrigerant therethrough as a function of inlet refrigerant phase, that operates automatically without operator intervention, that ensures that refrigerant at the compressor inlet is in vapor phase so as to prevent slugging and possible damage to the compressor, and that is adapted for use in connection with multiple differing types of refrigerants.

SUMMARY OF THE INVENTION

A refrigerant handling system in accordance with the present invention includes a compressor for pumping refrigerant through the system, and an evaporator connected to the compressor inlet for ensuring that refrigerant fed to the compressor inlet is in vapor phase. A flow control valve is coupled to the inlet of the evaporator for controlling flow of refrigerant to the evaporator. Refrigerant flow through the valve is controlled as a function of temperature of refrigerant at the evaporator outlet. Specifically, flow through the evaporator is controlled such that refrigerant is in vapor phase at the evaporator outlet. Thus, if liquid refrigerant is being fed to the evaporator inlet, flow is reduced so that the refrigerant has sufficient residence time in the evaporator to reach vapor phase. On the other hand, if inlet refrigerant is already in vapor phase, flow is increased so at to reduce residence time in the evaporator, and thus reduce superheating. Mixed liquid and vapor phase flow rate is between the minimum for all liquid and the maximum for all vapor.

In a preferred embodiment of the invention, the flow control valve comprises a thermostatic expansion valve having first and second pressure inputs, and valve elements for controlling flow of refrigerant through the valve to the evaporator as a function of a pressure differential between the pressure inputs. A first bulb containing refrigerant is sealingly coupled to the first pressure input of the valve, and is positioned so as to supply a first control pressure to the valve as a function of vapor pressure of refrigerant in the bulb at the temperature of refrigerant entering the evaporator. A second bulb containing refrigerant is sealingly coupled to the second pressure input of the valve, and is positioned to supply a second control pressure to the valve as a function of vapor pressure of refrigerant in the bulb at the temperature of refrigerant exiting the evaporator. Thus, flow of refrigerant to the evaporator is automatically controlled as a function of refrigerant temperature differential across the evaporator, and refrigerant flow through the system is automatically maximized as a function of inlet refrigerant phase or phases.

Preferably, the refrigerant sealed in the first and second bulbs are of the same refrigerant type —e.g. R502.

In this way, use of temperature differential across the evaporator, reflected by the vapor pressure differential between the refrigerant bulbs, automatically accommodates the differing operating characteristics of other types of refrigerant —e.g., R22 and R12.

In a second embodiment of the invention, the flow control valve comprises a thermal expansion valve coupled to a temperature sensor responsive to refrigerant temperature at the evaporator outlet. The valve element is coupled to a heat motor that is connected in series with the temperature sensor, preferably a thermistor, across a source of electrical power. In this way, current to the heat motor, and flow rate through the valve, are automatically responsive to evaporator outlet temperature without operator intervention.

BRIEF DESCRIPTION OF THE DRAWINGS

The invention, together with additional objects, features, and advantages thereof, will be best understood from the following description, the appended claims and the accompanying drawings in which:

DETAILED DESCRIPTION OF PREFERRED EMBODIMENTS

Figure 1:
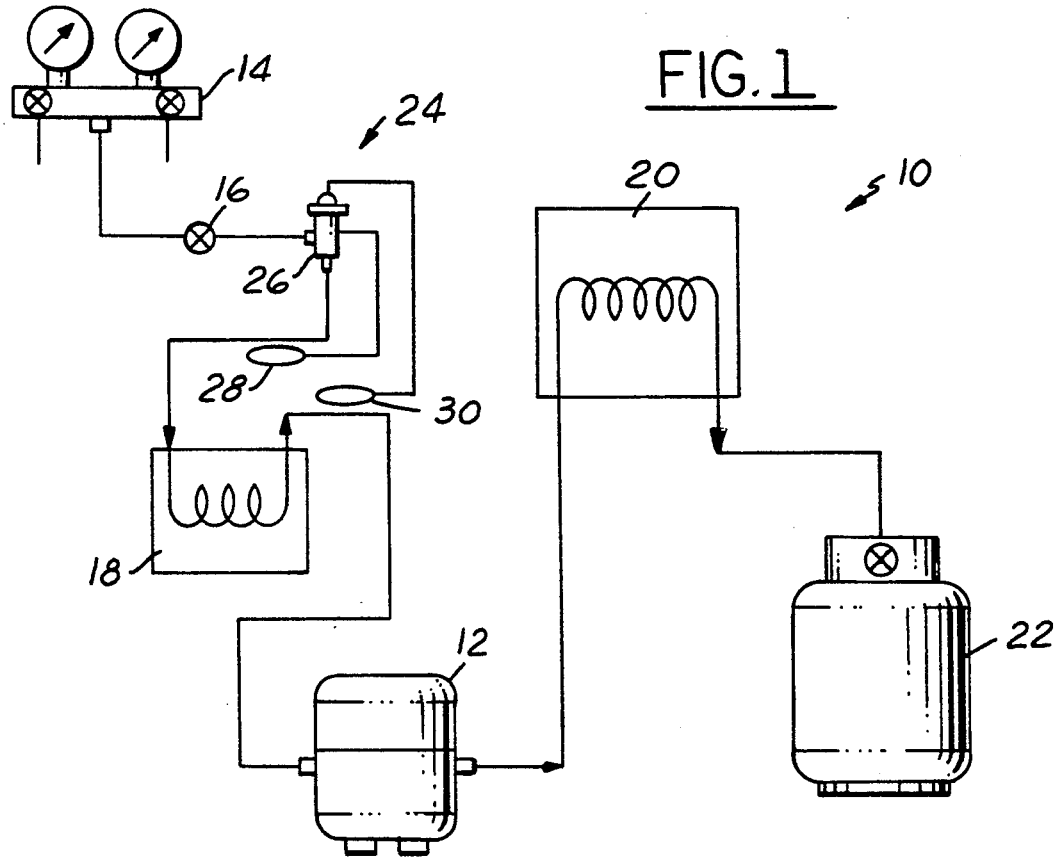
FIG. 1 is a schematic diagram of a refrigerant recovery system in accordance with one presently preferred embodiment of the invention.

FIG. 1 illustrates a refrigerant recovery system 10 in accordance with a presently preferred implementation of the invention as comprising a compressor 12 having an inlet that is coupled to an input manifold 14 through a valve 16 and an evaporator 18 for adding heat to refrigerant passing therethrough, and thereby ensuring that refrigerant at the inlet of compressor 12 is substantially in vapor phase. The outlet of compressor 12 is connected through a condenser 20 for extracting heat from and liquefying refrigerant passing therethrough, to an inlet port of a refrigerant storage container 22. Manifold 14 is adapted for connection to refrigeration equipment (not shown) from which refrigerant is to be recovered. When valve 16 is opened, either manually or electronically, and compressor 12 is operated, refrigerant is withdrawn from the equipment under service through evaporator 18 to the inlet of compressor 12, and is fed from the compressor outlet through condenser 20 to storage container 22. To the extent thus far described, system 10 is similar to those disclosed in U.S. Pat. Nos. 4,768,347 and 4,939,905 referenced above.

Figure 2:
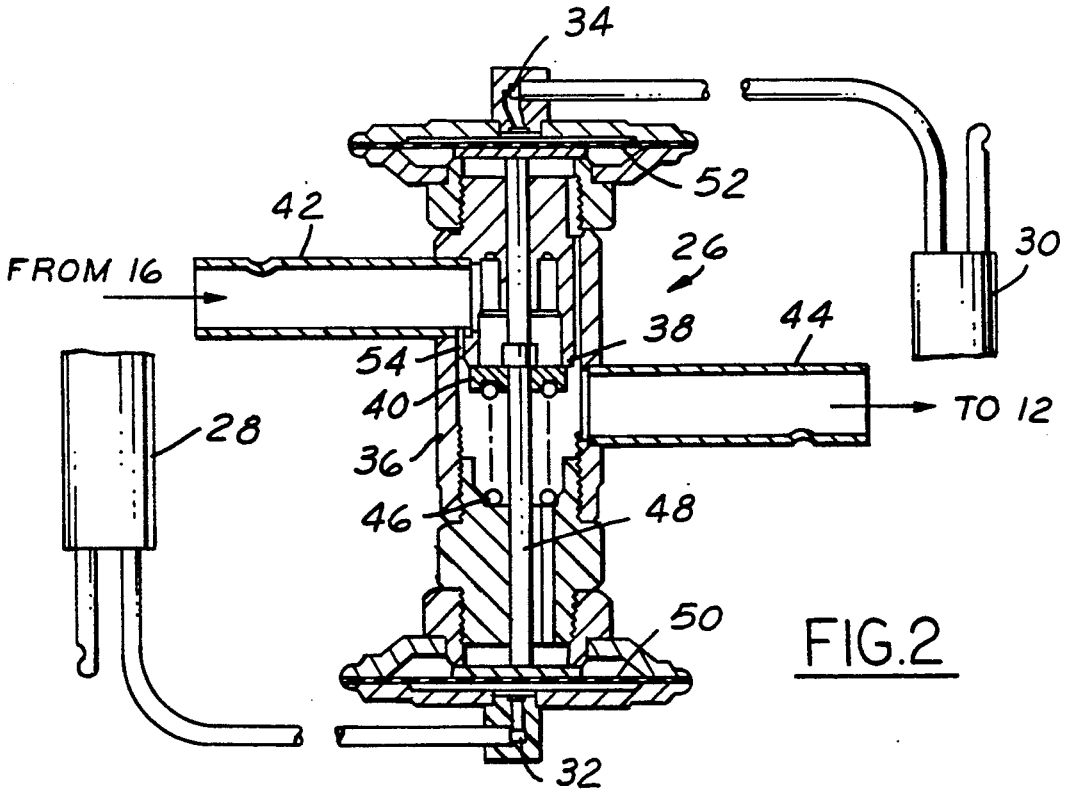
FIG. 2 is a fragmentary sectional view of the inlet flow control valve illustrated schematically in FIG. 1.

In accordance with the present invention, an inlet flow control device 24 controls flow of fluid to the inlet of evaporator 18. In the embodiment of FIGS. 1 and 2, flow control device 24 comprises a thermostatic expansion valve 26 having first and second pressure control input ports 32, 34 sealingly connected to respective first and second refrigerant bulbs 28, 30. First bulb 28 contains refrigerant of suitable selected type, and is positioned in heat transfer relationship with refrigerant entering the inlet of evaporator 18 so that the temperature of the refrigerant within bulb 28, and the vapor pressure of such refrigerant fed to valve control port 32, vary as a function of the temperature of refrigerant at the evaporator inlet. Likewise, second bulb 30 is coupled to the refrigerant conduit that the outlet of evaporator 18 so that the temperature of refrigerant within bulb 30, and the corresponding refrigerant vapor pressure fed to second valve control port 34, vary as a function of refrigerant temperature at the evaporator outlet. Most preferably, the refrigerants captured within bulbs 28, 30 are of the same type, such as R502.

As shown in FIG. 2, valve 26 comprises a valve body 36 having a valve seat 38 and a valve element 40 movable against and away from seat 38. A valve inlet fitting 42 is coupled to valve 16 (FIG. 1) for feeding refrigerant to one side of valve element 40. A valve outlet fitting 44 feeds refrigerant to compressor 12 from the opposing side of the valve seat. A coil spring 46 is captured in compression within valve body 36, and urges element 40 toward a closed position against seat 38. Element 40 is coupled by a shaft 48 to pair of axially opposed diaphragms 50, 52 captured in respective axially opposed diaphragm chambers. The outer sides of the diaphragms chambers are coupled to valve pressure control input parts 32, 34 respectively. A small passage 54 bypasses valve element 40 and seat 38 so as to meter refrigerant from inlet fitting 42 to outlet fitting 44 independent of valve position.

Thus, vapor pressure of refrigerant in bulb 28 combines with spring 46 to urge valve element 40 against seat 38, and to block flow of refrigerant through valve 26. On the other hand, vapor pressure of refrigerant within bulb 30, positioned at the outlet of evaporate 18, urges valve element 40 away from seat 38 against the force of spring 36 and the control pressure from bulb 28. Use of the same type of refrigerant in both bulbs 28, 30 allows flow control 24 to operate in conjunction with other types of refrigerant flowing through system 10, different from the type of refrigerant in the bulbs. As an example of operation, if liquid R22 is fed to valve inlet fitting 42 at 85° F., and the evaporator discharge temperature is 40° F., bulb 28 might provide a first control pressure to valve 26 equal to 70 psig (R502 saturation pressure at 33° F.), the outlet pressure of valve 26 might be 59 psig (R22 saturation pressure at 33° F.), and the control pressure at bulb 30 might be 80 psig (R502 saturation pressure at 40° F.). Spring 40 would be set under these conditions to provide refrigerant flow at a pressure differential of 10 psig, which would control superheat in evaporator 18 to 7° F. (including pressure effects).

Figure 3:
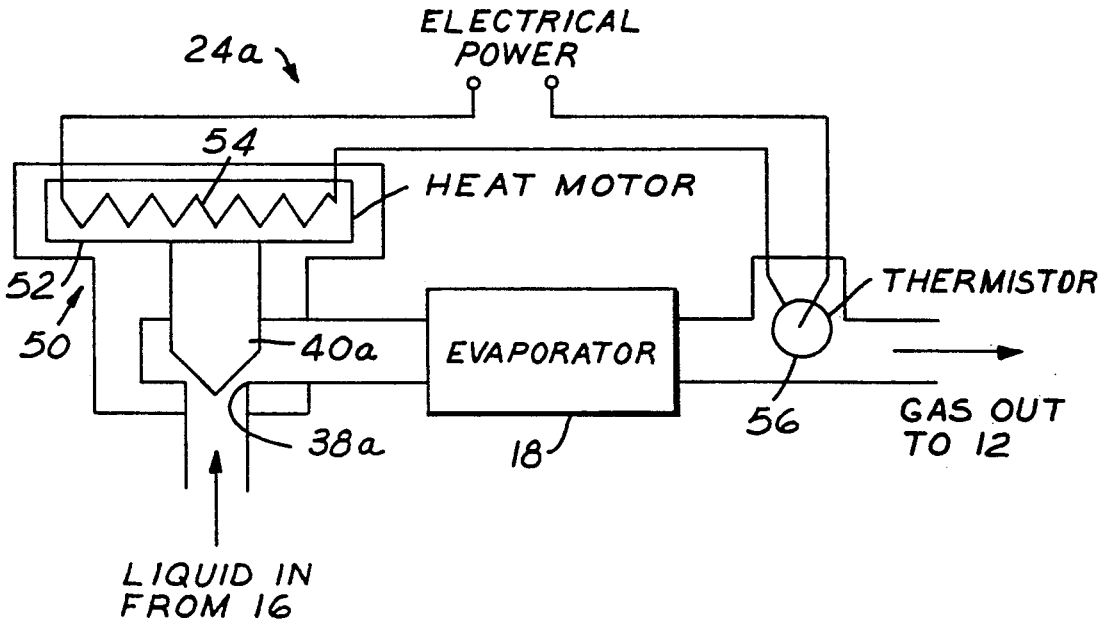
FIG. 3 is a schematic diagram of an inlet flow control valve in accordance with a modified embodiment of the invention.

FIG. 3 illustrates a modified flow, control device **24*a* that includes an electric expansion valve 50 having a heat motor 52 coupled to a valve element 40*a*. The heating element 54 of motor 52 is connected in series with a thermistor 56 across a source of electrical power. Thermistor 56 is positioned adjacent to the outlet of evaporator 18 so as to be responsive to the temperature of refrigerant exiting the evaporator outlet. Thus, an increase in temperature at the evaporator outlet reduces current to that motor 52. Such reduced current to heat motor 52 moves valve element 40*a* away from valve seat 38*a*, allowing passage of more refrigerant to evaporator 18, and thereby tending to reduce temperature at thermistor 56. Conversely, reduced temperature at thermistor 56 closes valve element 40*a* toward seat 38*a*** reducing refrigerant flow.

Although the invention has been disclosed in connection with a refrigerant recovery system 10 illustrated in FIG. 1, which is a presently preferred implementation of the invention, the invention in its broadest aspects is by no means limited to refrigerant recovery implementations. Indeed, the invention finds application in any type of refrigerant handling system in which a compressor is employed for pumping refrigerant through the system, in which the inlet refrigerant may be in liquid or mixed liquid/vapor phase, and/or in which inlet refrigerant may be of multiple differing types.

We claim:

1. In a refrigerant recovery system that includes a refrigerant compressor, a condenser for connecting the compressor to a refrigerant storage vessel and an evaporator for connecting the compressor to refrigeration equipment from which refrigerant is to be recovered, the improvement comprising:

a first refrigerant bulb containing refrigerant of preselected type disposed in heat transfer relationship to refrigerant entering said evaporator so that vapor pressure of refrigerant in said first bulb varies as a function of temperature of refrigerant entering said evaporator, a second refrigerant bulb containing refrigerant of the same said preselected type disposed in heat transfer relationship to refrigerant exiting said evaporator so that vapor pressure of refrigerant in second bulb varies as a function of temperature of refrigerant exiting said evaporator, and a refrigerant flow control valve operatively coupled to said first and second bulbs and positioned automatically to control flow of refrigerant into said evaporator as a function of a different between refrigerant vapor pressures in said first and second bulbs so as to provide a constant temperature rise in refrigerant flowing through said evaporator independent of pressure/temperature characteristics of the refrigerant flowing through said evaporator such that said refrigerant recovery system is adapted to be employed for recovering refrigerants of such differing pressure/temperature characteristics.

2. The system set forth in claim 1 wherein said valve comprises a valve seat, a valve element positioned to engage said seat, spring means urging said element against said seat, and means for moving said element off of said seat when force on said element due to said pressure differential exceeds force on said element from said spring means.

3. The system set forth in claim 2 further comprising bypass means for metering refrigerant past said element and seat independent of said pressure differential.

4. A method of recovering differing refrigerants having differing pressure/temperature characteristics employing a single refrigerant recovery system that includes a refrigerant compressor, a condenser connecting the compressor to a refrigerant storage vessel and evaporator means for connecting the compressor to refrigeration equipment from which refrigerant is to be recovered, said method comprising the steps of:

(a) connecting at the inlet of said evaporator means an expansion valve having a valve element, spring means urging said valve element to a closed position, and means responsive to a pressure differential in combination with said spring means for controlling position of said valve element, (b) positioning a first refrigerant bulb containing a predetermined type of refrigerant in heat transfer relationship to refrigerant entering said evaporator means so that vapor pressure of refrigerant in said first bulb varies as a function of temperature of refrigerant entering said evaporator means, (c) positioning a second refrigerant bulb containing the same said predetermined type of refrigerant in heat transfer relationship to refrigerant exiting said evaporator means so that vapor pressure of refrigerant in said second bulb varies as a function of temperature of refrigerant exiting said evaporator means, and (d) connecting said first and second bulbs on opposite sides of said means responsive to said pressure differential automatically to regulate refrigerant flow to said evaporator means and maintain a constant temperature increase in refrigerant flowing through said evaporator means, determined in part by said spring means, independent of pressure/temperature characteristics of the refrigerant flowing through said evaporator means without input or adjustment by an operator relating to refrigerant type.

5. A method of handling differing refrigerants having differing pressure/temperature characteristics employing a refrigerant handling system that includes a refrigerant compressor having an inlet an dan evaporator for feeding refrigerant in vapor phase to the compressor inlet, said method comprising the steps of:

(a) connecting at the evaporator inlet an expansion valve having a valve element, spring means urging said valve element to a closed position, and means responsive to a pressure differential in combination with said spring means for controlling position of said valve element, (b) positioning a first refrigerant bulb containing a predetermined type of refrigerant in heat transfer relationship to refrigerant entering said evaporator means so that vapor pressure of refrigerant in said first bulb varies as a function of temperature of refrigerant entering said evaporator means, (c) positioning a second refrigerant bulb containing the same said predetermined type of refrigerant in heat transfer relationship to refrigerant exiting said evaporator means so that vapor pressure of refrigerant in said second bulb varies as a function of temperature of refrigerant exiting said evaporator, (d) connecting said first and second bulbs on opposite sides of said means responsive to said pressure differential, and (e) feeding refrigerants having differing pressure/-temperature characteristics to said evaporator, said valve and bulbs cooperating automatically to regulate refrigerant flow to said evaporator and maintain a constant temperature increase in refrigerant flowing through said evaporator, determined in part by said spring means, independent of pressure/temperature characteristics of the refrigerant flowing through said evaporator.

* * * * *